US005722866A

United States Patent [19]

Brandt

[11] Patent Number: 5,722,866

[45] Date of Patent: Mar. 3, 1998

[54] PROPULSION ARRANGEMENT FOR A MARINE VESSEL

[76] Inventor: Lennart Brandt, Enevägen 15, S-430 33 FjärÅs, Sweden

[21] Appl. No.: 513,822

[22] PCT Filed: Mar. 2, 1993

[86] PCT No.: PCT/SE93/00178

§ 371 Date: Nov. 15, 1995

§ 102(e) Date: Nov. 15, 1995

[87] PCT Pub. No.: WO94/20362

PCT Pub. Date: Sep. 15, 1994

[51] Int. Cl.[6] ..... B63H 5/15

[52] U.S. Cl. ..... 440/67; 440/61; 440/75

[58] Field of Search ..... 440/66, 67, 75, 440/61, 88, 89

[56] References Cited

U.S. PATENT DOCUMENTS

| | | | |
|---|---|---|---|
| 2,975,750 | 5/1961 | Smith . | |
| 3,088,430 | 5/1963 | Champney | 440/75 |
| 3,122,123 | 2/1964 | Shallbetter et al. | 440/75 |
| 3,137,265 | 6/1964 | Meyerhoff | 440/67 |
| 3,149,605 | 9/1964 | Broadwell | 440/67 |
| 3,389,558 | 6/1968 | Hall | 440/67 |
| 3,455,268 | 7/1969 | Gordon | 440/67 |
| 3,476,070 | 11/1969 | Austen | 440/67 |
| 3,499,412 | 3/1970 | Anthes et al. . | |
| 3,707,939 | 1/1973 | Berg . | |
| 3,742,895 | 7/1973 | Horiuchi | 440/66 |
| 3,951,096 | 4/1976 | Dunlap | 440/66 |
| 4,074,652 | 2/1978 | Jackson | 440/58 |
| 4,427,393 | 1/1984 | May . | |
| 5,181,868 | 1/1993 | Gabriel . | |

FOREIGN PATENT DOCUMENTS

| | | | |
|---|---|---|---|
| 0 298 053 | 1/1989 | European Pat. Off. . | |
| 0 425 723 A1 | 5/1991 | European Pat. Off. . | |
| 1387903 | 12/1964 | France . | |
| 1 808 637 | 6/1970 | Germany . | |
| 2044274 | 3/1971 | Germany . | |
| 143093 | 9/1980 | Norway . | |
| 342011 | 1/1972 | Switzerland . | |
| 2188300 | 9/1987 | United Kingdom | 440/67 |

*Primary Examiner*—Sherman Basinger
*Attorney, Agent, or Firm*—Samuels, Gauthier, Stevens & Reppert

[57] ABSTRACT

A propulsion arrangement for a marine vessel having a propulsion unit. The propulsion unit includes a non-rotating housing in the form of a nozzle extending along a principal axis, the nozzle having an inlet opening, an outlet and an internal diameter; a propeller mounted for rotation within the nozzle, the propeller having a plurality of blades radially outwardly delimited by a periphery; a support shaft extending along the principal axis of the nozzle and to which shaft the propeller is affixed; and a support shaft support member in the form of a plurality of arms extending substantially radially from the inner surface of the nozzle to a bearing hub for the support shaft. The plurality of arms are located upstream of the propeller, the arms being shaped so as to impart a pre-rotation on the flow of water upstream of the propeller. The internal diameter of the nozzle gradually decreases from a maximum at the inlet opening to a minimum within the nozzle and then increases towards the outlet. The propulsion unit is coupled to the marine vessel in such a manner that the propulsion unit can be trimmed to a desired angle to cause the nozzle to generate a hydrodynamic lift component at the stern of the marine vessel.

22 Claims, 8 Drawing Sheets

PROPULSION ARRANGEMENT FOR A MARINE VESSEL

TECHNICAL FIELD

The present invention relates to a propulsion arrangement for a marine vessel, comprising a propulsion unit having a non-rotating housing in the form of a nozzle extending along a principal axis, a propeller mounted for rotation within said nozzle, a support shaft extending along the principal axis of the nozzle and to which shaft said propeller is affixed, and support shaft support means in the form of a plurality of arms extending substantially radially from the inner surface of the nozzle to a bearing hub for the support shaft.

BACKGROUND OF THE INVENTION

It is a general goal within the marine industry to provide vessels which are more efficient. The efficiency of a vessel is determined predominantly by the design of its hull and the effectiveness of its propulsion means. In terms of a vessel's hull, the greater the wetted area of the hull, the greater the frictional forces which arise. Thus phenomena has led to the development of planing-hull vessels which are particularly adapted for high speeds. As described in U.S. Pat. No. 4 597 742, to improve the efficiency of the hull and drive system at hull-planing speeds, a submerged trim hydrofoil can be affixed to the drive housing of the drive system beneath the screw propeller drive shaft.

In terms of marine propulsion means, most vessels employ one or more propellers, driven either by an inboard or an outboard motor. Including losses due to the resistance of its submerged housing, etc., a normal propeller has a total efficiency of around 55–65%, i.e. the losses can be as high as 45%. The largest undesired losses are due to the rotation of the water downstream of the propeller. This rotation is made up of a rotating "cylinder" of water as well as eddy-currents caused by water flow from the pressure side of the propeller blades to the suction side. Clearly, if the efficiency of the propeller can be increased, then the fuel consumption of the power unit as well as the required power input will be reduced. Since high propeller blade speeds induce cavitation and increase noise levels, it is advantageous if the rotational speed of the propeller can be reduced, whilst still maintaining adequate forward propulsion.

A further important consideration is that of safety. Particularly for inshore vessels, an exposed propeller can create a danger for persons who may be bathing in the vicinity.

There have been many attempts to improve conventional propellers to satisfy some or all of the above-described demands. A popular means to reduce the rotating "cylinder" of water is to employ a twin, counter-rotating propeller drive. Such a construction does not, however, offer a solution to the remaining aspects identified above.

From NO-B-143 093 it is known that the efficiency of a propeller can be increased by encapsulating the propeller in a housing having the form of a nozzle. In said document, the propeller is mounted for rotation within the nozzle and is carried on a propeller shaft whose remote end is supported in a bearing hub. The bearing hub is in turn supported by a plurality of radially extending arms or vanes within the nozzle. Vanes are also provided within the nozzle upstream of the propeller. Both sets of vanes are shaped to control the flow of water through the nozzle in an attempt to minimize rotational losses. In said document, though, these vanes present a relatively long chord length, which results in the large surface area of the vanes giving rise to frictional losses. The propulsion unit according to NO-B-143 093 may also be rotatable about a vertical axis to provide a steering function.

Further examples of encapsulated marine propulsion units are described in EP-A-0 425 723 FR-A-1 387 903, U.S. Pat. No. 4 427 393, SE-B-342 011 and U.S. Pat. No. 4 074 652. All these units are either rigidly affixed to a vessel or are capable of rotation about a vertical axis to provide a steering function.

Whilst propulsion units incorporating an encapsulated propeller have been shown to offer significant advantages over exposed propellers, none of the above-described propulsion arrangements contributes to an improvement of the efficiency of the vessel hull to which they are fitted.

SUMMARY OF THE INVENTION

It is therefore an object of the present invention to provide a more efficient propulsion arrangement for a marine vessel, which propulsion arrangement also contributes to a reduction in the drag losses of the hull of the vessel to which it is fitted.

This object is achieved in accordance with the present invention by means of a propulsion arrangement of the type indicated in the preamble of claim 1, which is characterized in that the propulsion unit is coupled to the marine vessel in such a manner that the propulsion unit can be trimmed to a desired angle .to cause the nozzle to generate a lift component at the stern of the vessel.

In this manner, the plane angle of even a stern-heavy boat can be easily adjusted to an optimal value by trimming the propulsion unit. This in turn implies that the power demands on the propulsive motor is less than with a conventional propulsion arrangement. Since the power requirements of the motor are less, the motor can be made relatively smaller and therefore lighter.

Preferred embodiments of the propulsion arrangement according to the present invention are detailed in the dependent claims. A particularly advantageous embodiment is that in which the propeller is driven at its periphery, preferably by a flexible belt. Such a construction offers considerable benefits, not least in that there is no flow of water over the tips of the propeller blades. It is therefore envisaged that a peripherally-driven, encapsulated propeller arrangement can be produced and sold without the lift-generating function as detailed in claim 1.

BRIEF DESCRIPTION OF THE DRAWINGS

The invention will be described in the following by way of example only and with reference to the attached drawings, in which FIG. 1 schematically illustrates the installation of a propulsion arrangement according to the present invention in a vessel in which the propulsion unit is arranged on the vessel's hull.

BEST MODE OF CARRYING OUT THE INVENTION

Figure 1:
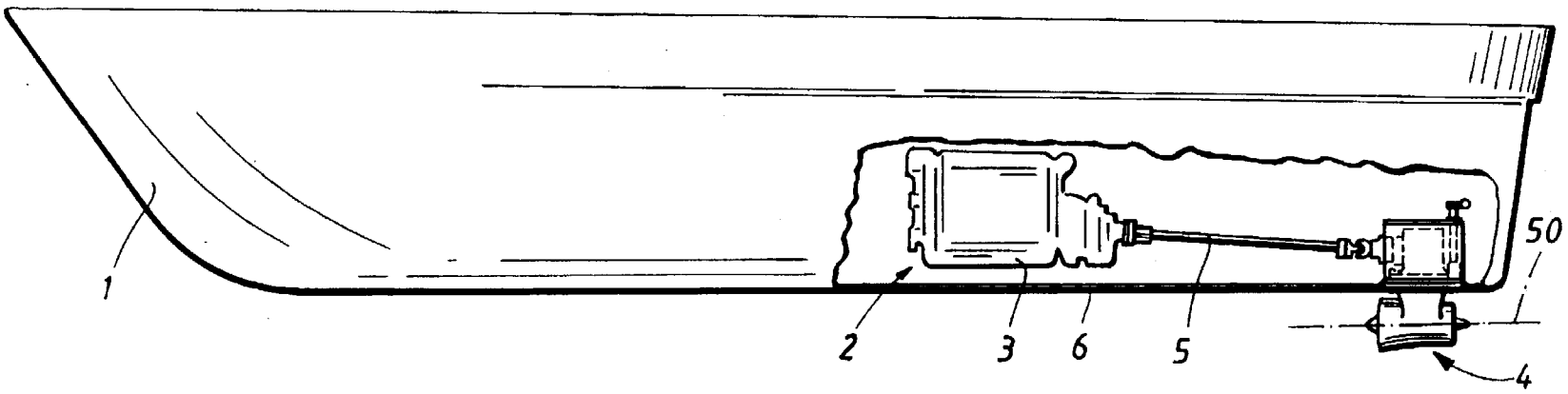
Figure 2:
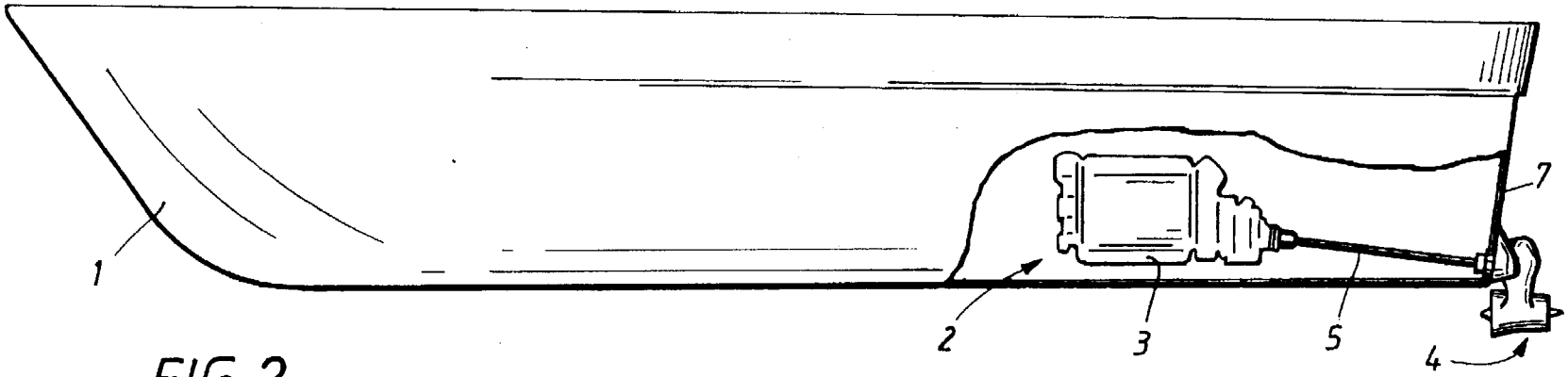
FIG. 2 is a view corresponding essentially to that of FIG. 1, though with the propulsion unit mounted to the transom of the vessel.

In FIGS. 1 and 2, reference numeral 1 denotes a marine vessel provided with a propulsion arrangement, generally denoted by 2, in accordance with the present invention. The propulsion arrangement consists substantially of a motor 3 and a propulsion unit generally denoted by reference numeral 4. In the vessels shown in FIGS. 1 and 2, the motor 3 is mounted inboard and power is transmitted to the propulsion unit 4 via a drive shaft 5.

The power unit 4 shown in FIG. 1 is mounted on the bottom of the hull 6 towards the stern of the vessel. The power unit presents a principal axis 50 extending substantially in the direction of movement of the vessel. In accordance with the present invention, the propulsion unit is arranged on the hull in such a manner that the unit can be trimmed so that the principal axis 50 can subtend a desired angle with a plane accommodating the water surface (not shown) surrounding the vessel i in order to generate a lift component at the stern of the vessel. In the arrangement shown in FIG. 1, this angle is preselected, with the size of the angle depending on the geometry of the hull 6, the weight and location of the motor 3 and the dimensions of the power unit 4. Optionally, the power unit 4 may also be pivotable about a substantially vertical axis so that the power unit also imparts a steering function to the vessel.

In the vessel shown in FIG. 2, the power unit 4 is mounted to the transom 7 of the vessel. As is more clearly derivable from FIG. 3, the propulsion unit comprises a non-rotating housing in the form of a nozzle 10. In a manner which will be described in greater detail below, the nozzle 10 is carried by the transom 7 so as to be pivotable about a transversely extending axis 60. Pivotal displacement of the nozzle 10 is achieved with the help of a hydraulic cylinder arrangement 11.

Figure 3:
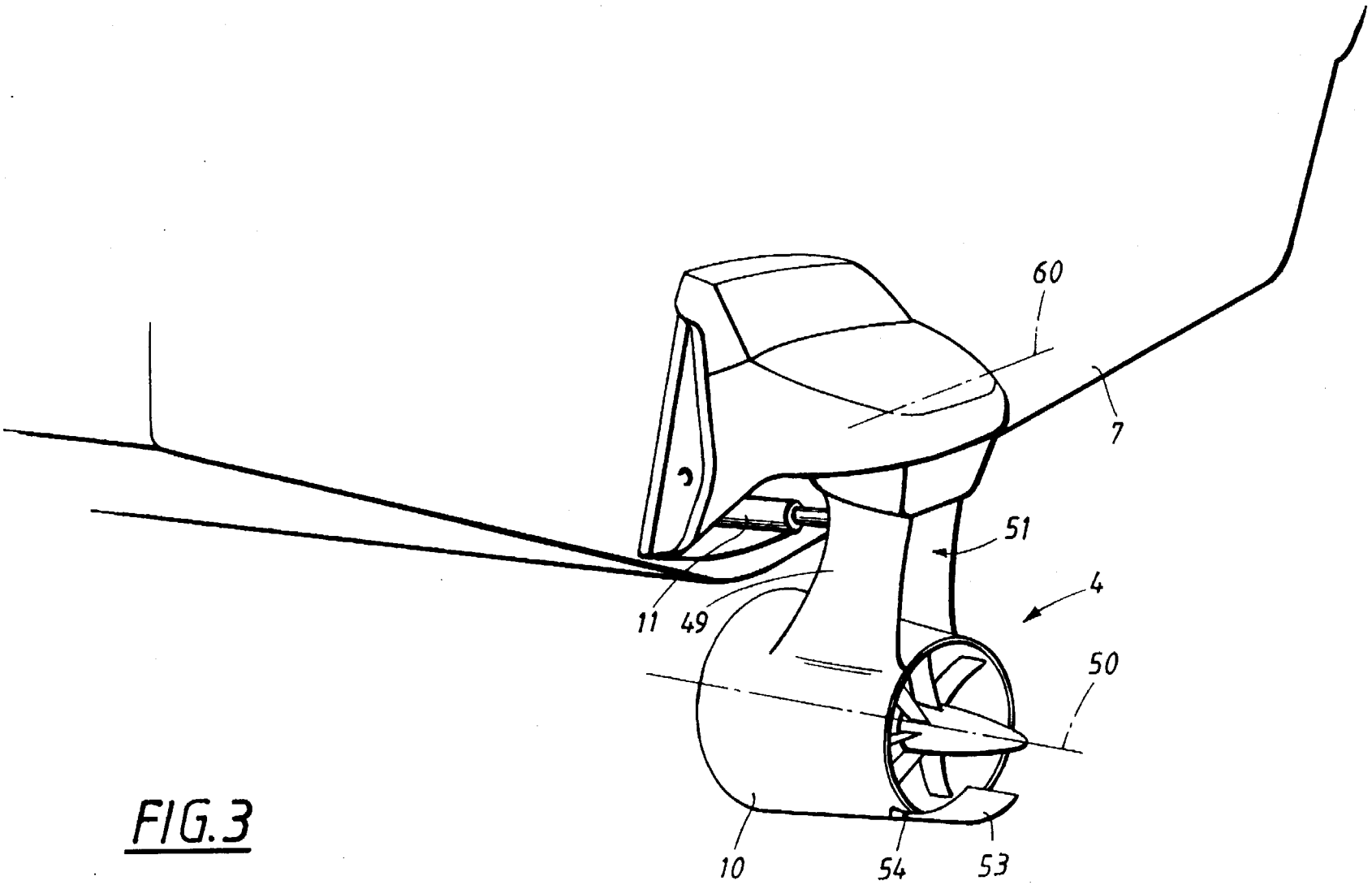
FIG. 3 is a perspective view of the propulsion unit shown in FIG. 2.
Figure 5:
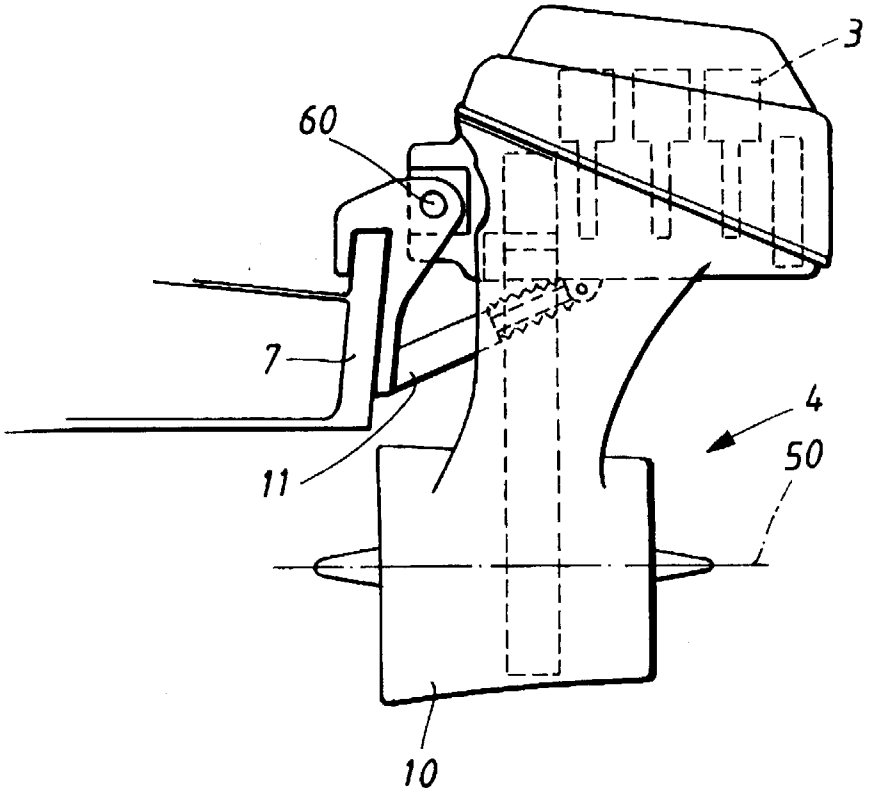
FIG. 5 is a schematic elevational view of the motor shown in FIG. 4.
Figure 4:
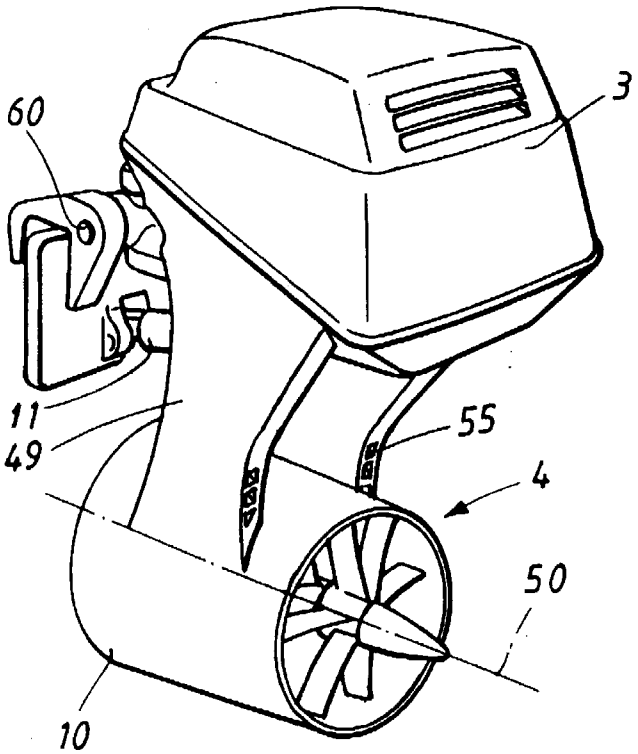
FIG. 4 is a perspective view of a propulsion arrangement according to the invention in the form of an outboard motor.

The propulsion arrangement illustrated in FIGS. 4 and 5 differs from that shown in FIGS. 2 and 3 in that the motor 3 is mounted outboard, directly above the propulsion unit 4. In this manner, both the nozzle 10 and the motor 3 are arranged to be pivotable as a single unit about the pivot axis 60. As in the embodiment of FIG. 3, this pivotal displacement is effected by a hydraulic cylinder arrangement 11.

Figure 6:
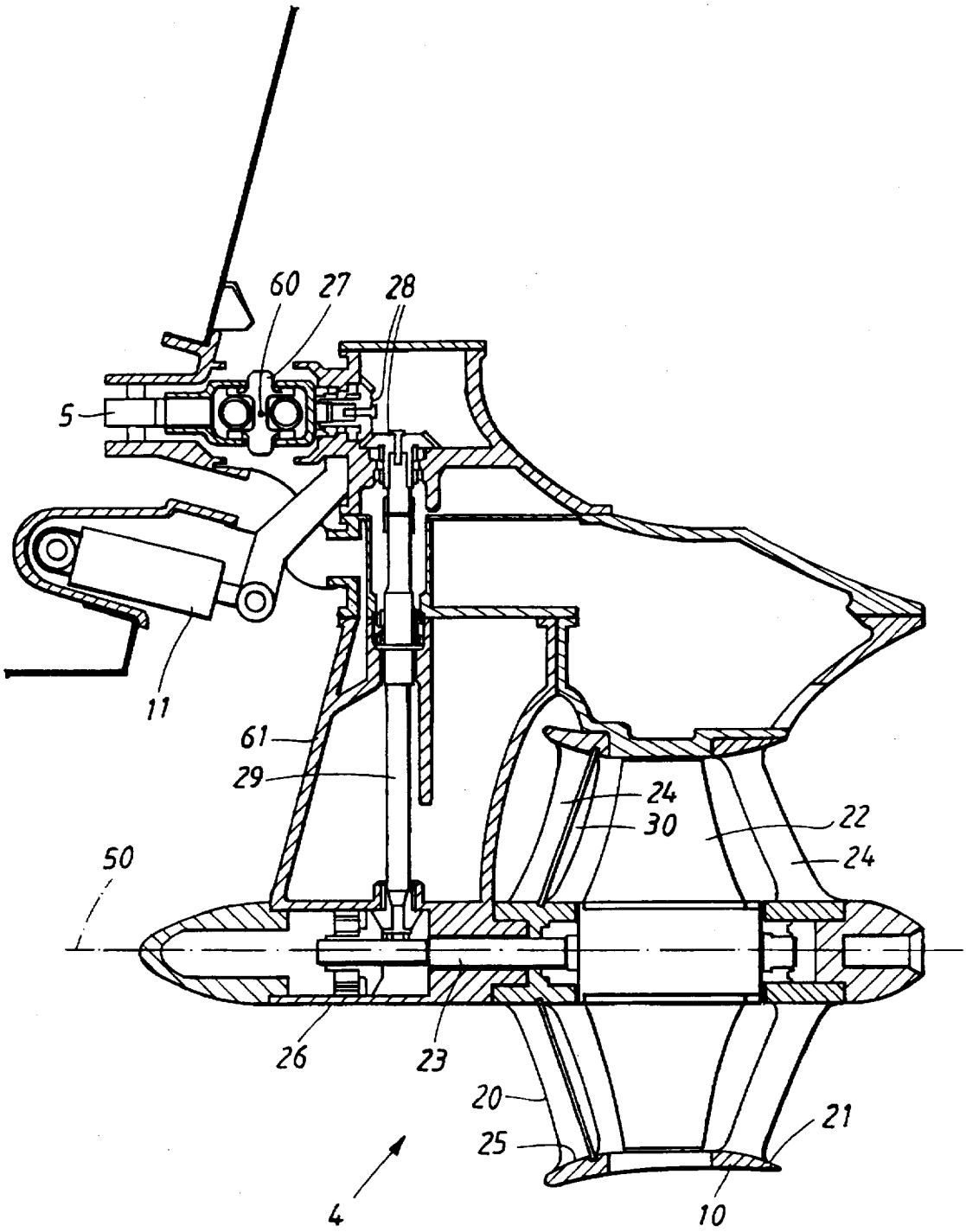
FIG. 6 is a sectional view through the nozzle of a propulsion unit according to one embodiment of the invention.

One possible embodiment of the propulsion arrangement is shown in FIG. 6. As mentioned earlier, the unit 4 includes a housing or nozzle 10 extending along a principal axis 50. The nozzle 10 presents an inlet opening 20 and an outlet 21. Preferably, the internal diameter of the nozzle gradually diminishes from a maximum at the inlet opening to a minimum within the nozzle and then increases towards the outlet 21. Advantageously, the diameter of the outlet 21 is some 85%–95% of the diameter of the inlet opening 20. In section, the nozzle wall is wing-shaped, with the inner surface 25 corresponding to the suction side of a wing and the outer surface the pressure side. Typically, the maximum nozzle wall thickness is less than 15% of the chord length of the nozzle wall.

Arranged within the nozzle 10 between the inlet 20 and the outlet 21, substantially in the region of smallest diameter, there is disposed a propeller 22 affixed to a support shaft 23, the shaft extending along the principal axis 50. The support shaft 23 is carried by support means in the form of a plurality of arms 24 extending substantially radially from the inner surface 25 of the nozzle to a bearing hub 26 for the support shaft 23. Preferably, a set of support arms 24 is located both upstream and downstream of the propeller 22.

Power is transmitted to the propeller from the (not shown) motor via the drive shaft 5, a constant velocity joint such as a cardan joint 27, a bevel gear arrangement 28 and an intermediate shaft 29 disposed in an essentially vertical plane.

The intermediate shaft 29 passes through a streamlined cowling 61 to cooperate with a gear arrangement within the upstream hub 26. The gear arrangement within the hub 26 transmits power to the propeller support shaft 23 and thus to the propeller 22. In order to allow the power unit 4 to be trimmed by the hydraulic cylinder arrangement 11, the pivot axis 60 is arranged to pass through the cardan joint 27.

Whilst the above-described propulsion arrangement ensures that a lift component is generated, thereby improving the efficiency of the vessel to which it is attached, the propulsion arrangement itself can be advantageously adapted to improve its efficiency. Thus, the arms 24 may be shaped so as to act as guide vanes for the water flowing through the nozzle 10. In this manner, a pre-rotation can be imparted on the flow upstream of the propeller 22. Similarly, by selecting a suitable angle of the vanes downstream of the propeller 22, the losses resulting from rotation of the water leaving the propeller can be reduced.

Figure 7:
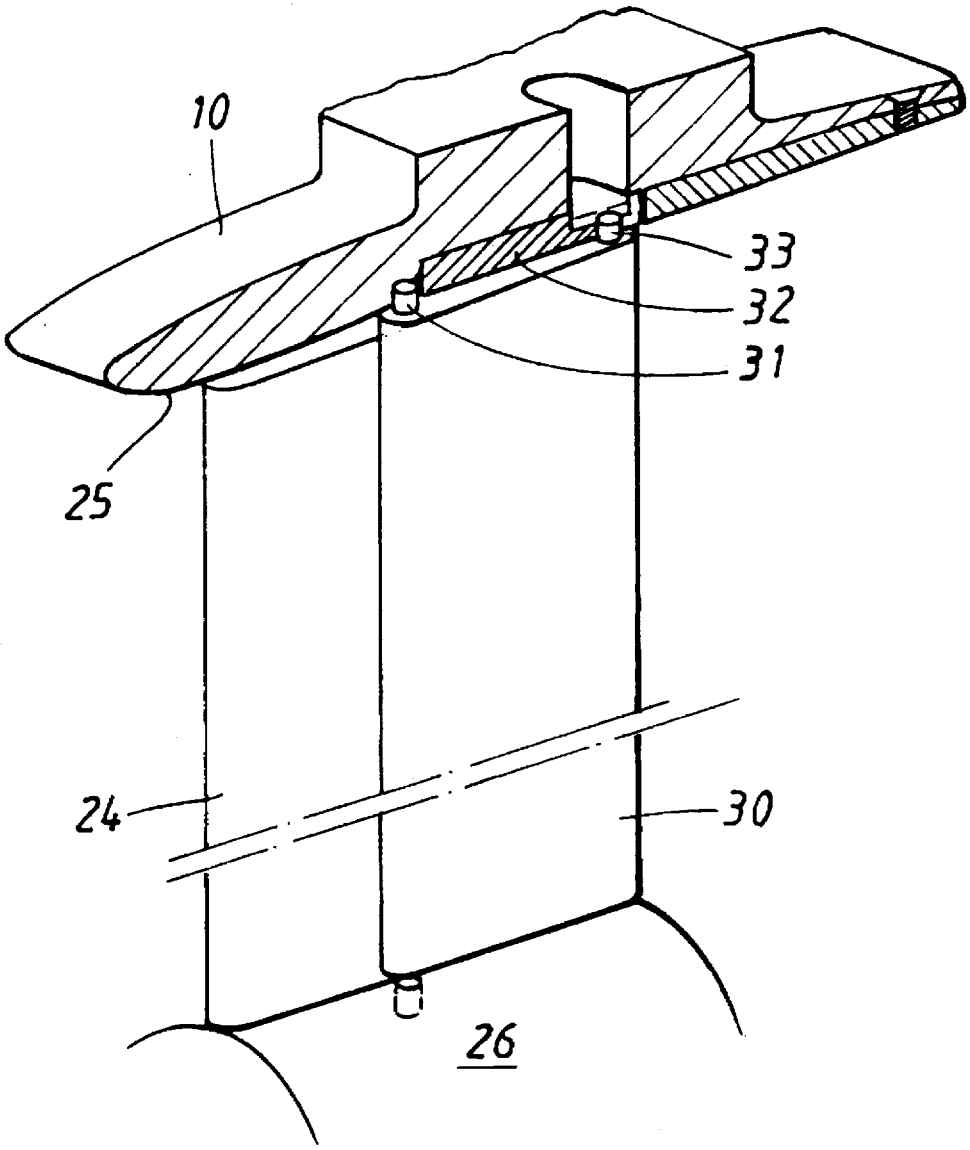
FIG. 7 is a schematic perspective view of a guide vane within the propulsion unit.

In a more preferred embodiment of the invention, the upstream vanes 24 are provided with adjustable flaps 30 which form the trailing portion of the vanes. This is more clearly illustrated in FIG. 7. Preferably, each flap 30 extends along the entire length of the vane 24 with which it is associated. The flap 30 is arranged for pivotal displacement about an axis 31 which extends parallel to the vane 24, i.e. substantially radially from the hub 26 to the inner surface 25 of the nozzle 10. Adjustment of the pitch of the flap 30 can be suitably effected by displacement of a ring 32 extending circumferentially around, and recessed into, the inner surface 25 of the nozzle 25. Suitable cooperation means, such as a peg 33 and slot arrangement, is provided between the ring 32 and the flap 30 to convert the rotational displacement of the ring into pivotal movement of the flap. The ring itself may be caused to be displaced by a gear wheel or linkage arrangement responsive to commands from the helmsman.

The provision of the displaceable flaps 30 allows the extent to which the propeller is loaded by the water flow through the nozzle 10 to be altered by varying the direction of flow upstream of the propeller. Thus, by altering the pitch of the flaps 30 so as to create a large deflection of flow, the flow will increase the load on the propeller, thereby reducing the speed of rotation of the propeller. If this pitch alteration is effected at a motor speed which is higher than that at which the motor develops its peak torque, it is possible to alter the flap pitch until the motor's speed is reduced to the peak torque level, whilst the propeller still produces a sufficient axial force to maintain the desired forward velocity of the vessel. Conversely, if it is desired to accelerate the vessel as quickly as possible, the flaps are adjusted to ensure that the flow imparts as low a load on the propeller, e.g. by returning the flaps to a position essentially in line with the vanes 24. In this manner, the motor can reach more quickly its engine speed at which it develops peak power.

Optionally, the downstream vanes may also be provided with adjustable flaps.

So that frictional losses of the flow over the vanes 24 is kept to a minimum, the chord length of the vanes and flaps should be shorter than the principal chord length around 0.7 radius of the blades making up the propeller 22.

Figure 9:
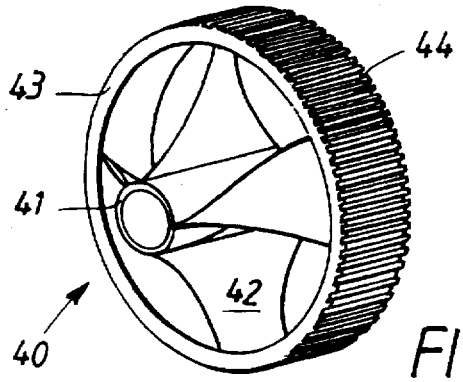
FIG. 9 is a perspective view of a propeller rotor for use in the propulsion unit depicted in FIG. 8.
Figure 10:
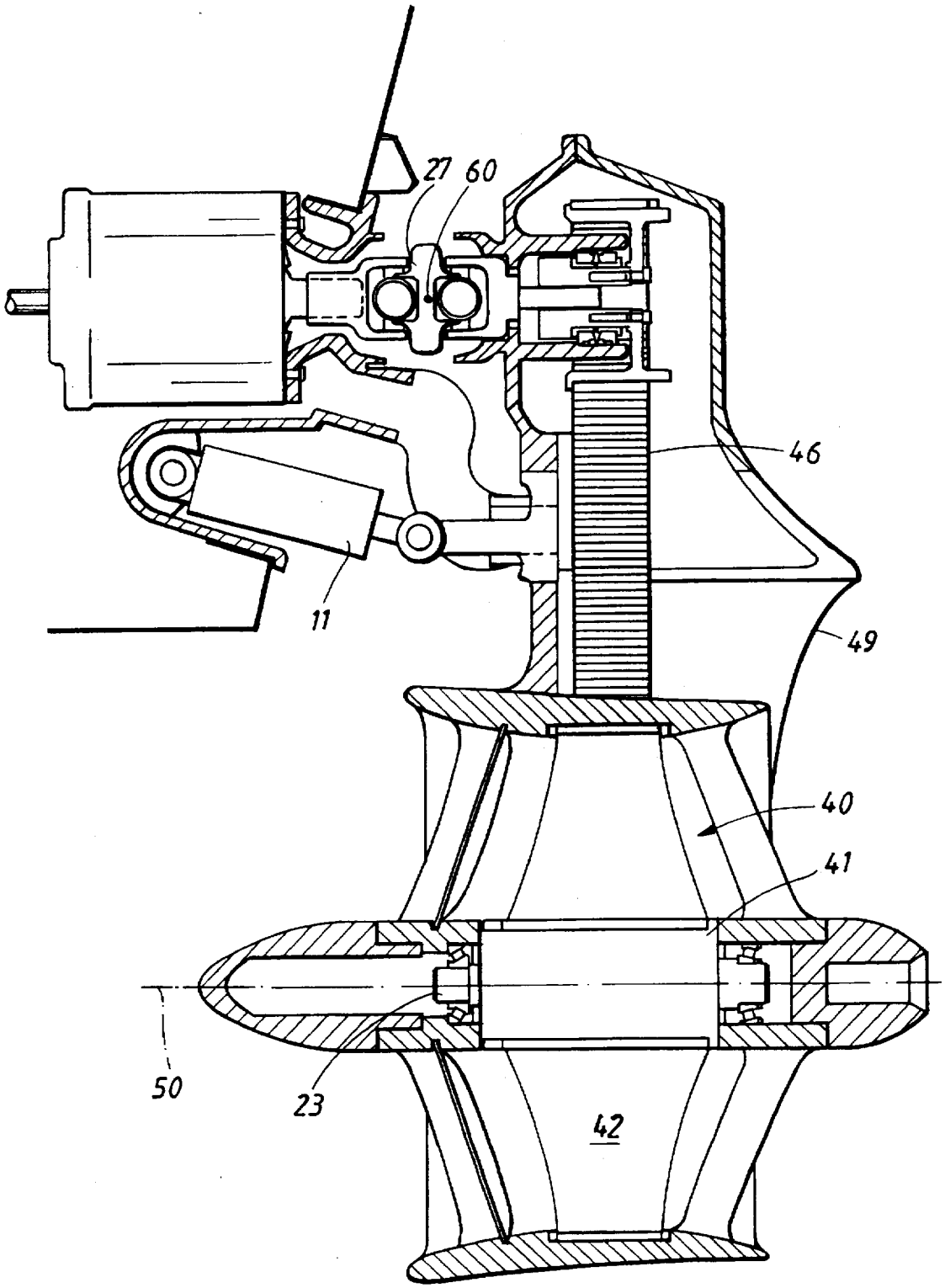
FIG. 10 is a sectional view in a substantially vertical plane through the propulsion unit shown in FIG. 8.

As mentioned earlier, a further cause of losses is the flow from the pressure side of the propeller blades to the suction side. To eliminate this loss, in a preferred embodiment of the invention shown in FIGS. 8 to 10, the propeller is in the form of a rotor, generally denoted by reference numeral 40. The rotor 40 consists of a hub portion 41 which is carried on the support shaft 23 extending between the upstream and downstream bearing hubs 26. From the hub portion 41 a plurality of propeller blades 42, preferably at least four in number, suitably six or more, extend radially outwards to join a circumferential peripheral ring 43. The peripheral ring 43 is provided on its radially outwardly facing surface with a toothed rack 44 extending around the entire ring. The teeth of the rack are ,arranged substantially parallel to the principal axis 50 of the nozzle 10. Accordingly, the rotor 40 has a plurality of blades, and the ratio cord length to the thickness of the blades at 0.7 radius lies between 9% and 15%. Furthermore, the rotor 40 is made from a plastic material.

Figure 8:
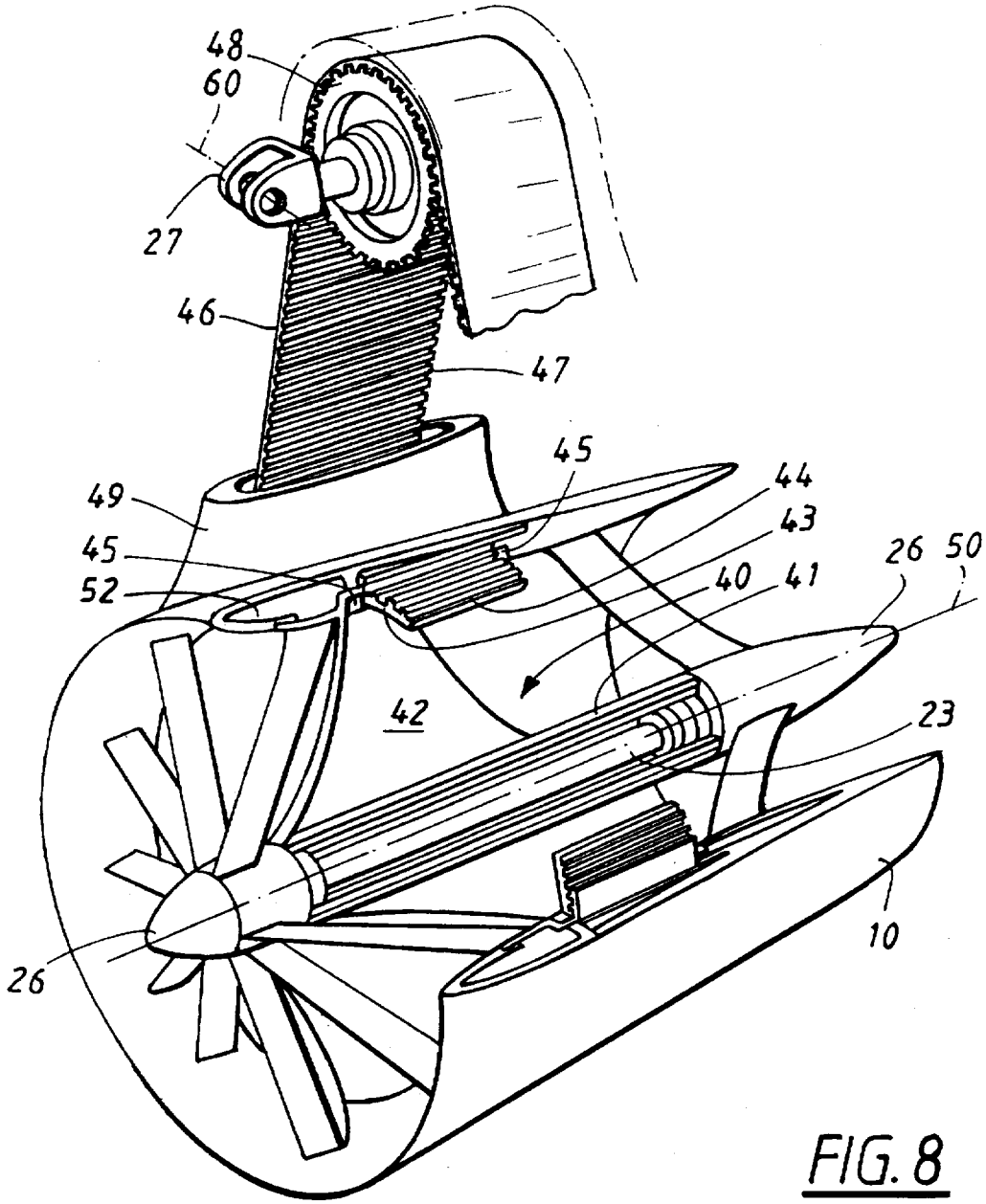
FIG. 8 is a partial sectional view through the nozzle of a propulsion unit according to a further embodiment of the invention.

With particular reference to FIG. 8, the rotor is carried for rotation between the bearing hubs 26 within the nozzle 10. The internal diameter of the peripheral ring 43 corresponds essentially to that of the inner surface of the nozzle 10 at the location of the rotor. Thus, the peripheral ring 43 is recessed in the nozzle 10. To prevent ingress of water, sealing means 45 are provided in the nozzle on either side, axially, of the peripheral ring 43. Dynamic axial forces are accommodated by the bearings in the hubs 26.

Although it is conceivable that the rotor 40 be driven by the type of shaft arrangement described in relation to FIG. 6, in an advantageous embodiment of the invention the rotor 40 is driven at its peripheral ring 43 by means of a flexible belt, denoted by reference numeral 46. In its installed condition, the flexible belt 46 forms a loop, the inside surface of which is provided with teeth 47 intended for cooperation with the toothed rack 44 on the peripheral ring 43 of the rotor 40. Power is transmitted to the flexible belt 46 from a not shown motor via a cardan joint 27 to a gear wheel 48. The cardan joint 27 provides the pivot axis 60 for the drive unit 4 about which the unit can be trimmed by hydraulic cylinder means, such as that shown in FIG. 3 and denoted by reference numeral 11.

In order to allow the propulsion unit to be adapted to different motor characteristics, a plurality of gear wheels 48 of varying diameter may be available. To simplify the exchange of said gear wheels 48, an adjustable belt tensioner may be incorporated in the drive system.

In order to protect the various components of the above-described power transmission arrangement from water, the flexible belt is encapsulated in a streamlined housing 49. As readily seen in FIG. 3, the housing 49 is in the form of two legs which form tangents to the nozzle 10. A gap is created between the two legs to thereby form a through passage 51. The streamlined shaping of the housing 49 and the provision of the through passage 51 contribute to a reduction in drag of the propulsion unit 4 through the water.

As illustrated in FIG. 8, the nozzle 10 may be provided with a circumferentially extending internal passage 52 upstream of the rotor 40. Where circumstances dictate, this passage 52 can be connected to the fresh-water cooling system of the motor to act as a heat exchanger for the cooling medium.

To assist in the trimming of the power unit 4, the nozzle 10 may be provided with at least one trim flap 53 arranged downstream of the rotor 40 towards the outlet 21 of the nozzle, as shown in FIG. 3. The trim flap 53 is arranged for rotation about a pivot axis 54 extending transverse to the principal axis 50 of the nozzle 10.

Similarly, to assist in the steering of the vessel, the nozzle 10 may also be provided with steering flaps downstream of the rotor. The steering flaps are arranged to pivot about a generally vertical axis and may be connected to the vessel's rudder system. In this manner, quicker responses to steering inputs at the helm are assured.

The losses incorporated in the flow of water exiting the nozzle 10 can be further minimized by arranging outlets 55 for exhaust gases from the vessel's motor downstream of the rotor, either in the housing 49 (see FIG. 4) or towards the outlet 21 of the nozzle 10.

Figure 11:
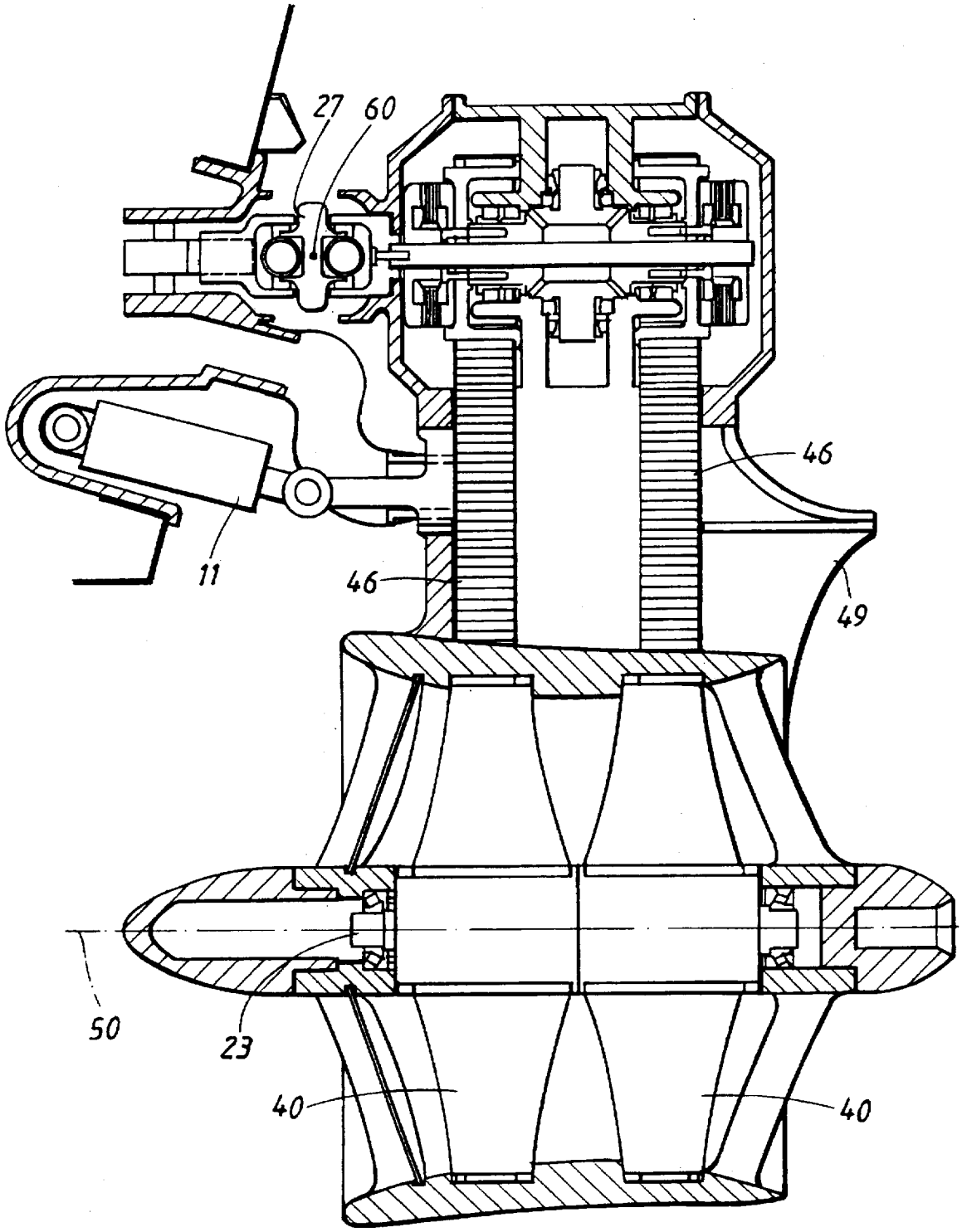
FIG. 11 is a sectional view in a substantially vertical plane through a further embodiment of the propulsion arrangement according to the invention.

In FIG. 11, a further embodiment of the propulsion arrangement according to the invention is shown. Within the nozzle 10, two coaxial, counter-rotating rotors 40 are provided, with each rotor being driven by a flexible belt 46.

Compared to a typical conventional exposed propeller, the rotor arrangement according to the invention in which the rotor is housed within a nozzle offers considerable advantages. As can be gleaned from the following table, for a conventional propeller intended for use on planing boats, the propeller blades lift coefficient is usually about 0.1. With the propulsion arrangement according to the invention in which the rotor is housed within a nozzle and the flow through the nozzle is controlled by variable pitch vanes, it is possible to increase the lift coefficient to 0.15.

In Table I, the given blade velocity is the maximum permitted blade velocity before cavitation occurs. Due to the lower angular velocity of the rotor according to the invention, the relative thickness of the blade can be considerably greater than that for a conventional propeller. This implies that the rotor blade can tolerate greater variations of flow direction without inducing cavitation. In turn, this means that material constraints are eased and it is viable that the rotor of the invention be made from a plastics material. The provision of at least four rotor blades, and preferably six or more, increases both the blade surface area and the support given to the peripheral ring 43.

TABLE I

| Design bending stress N/mm$^2$ | | | 80 | 120 | 180 |
|---|---|---|---|---|---|
| Lift coefficient | Cl | Conv. propeller | 0.10 | 0.10 | 0.10 |
| | | Invention | 0.15 | 0.15 | 0.15 |
| Blade velocity knot | Va | Conv. propeller | 52.8 | 56.9 | 60.9 |
| | | Invention | 39.1 | 42.5 | 45.8 |
| CHORD mm | c | Conv. propeller | 100.0 | 100.0 | 100.0 |
| | | Invention | 66.7 | 66.7 | 66.7 |
| Thickness mm | t | Conv. propeller | 7.9 | 6.5 | 5.3 |
| | | Invention | 9.7 | 7.9 | 6.5 |
| Relative thickness | t/c % | Conv. propeller | 7.9% | 6.5% | 5.3% |
| | | Invention | 14.5% | 11.9% | 9.7% |

Naturally, the present invention is not restricted to that shown in the drawings and described above, but may be varied within the scope of the appended claims. For example, more than two propellers or rotors may be coaxially located within the nozzle. Furthermore, a pair of diametrically opposed fins or hydrofoils may be provided on the exterior surface of the nozzle to promote the desired lift effect. These fins or hydrofoils may also incorporate adjustable flaps.

I claim:

1. A propulsion arrangement for a marine vessel, said arrangement comprising a propulsion unit including:

a non-rotating housing in the form of a nozzle extending along a principal axis, said nozzle having an inlet opening, an outlet and an internal diameter;

a propeller mounted for rotation within said nozzle, said propeller having a plurality of blades radially outwardly delimited by a periphery;

a support shaft extending along the principal axis of the nozzle and to which shaft said propeller is affixed; and support shaft support means in the form of a plurality of arms extending substantially radially from the inner surface of the nozzle to a bearing hub for the support shaft, wherein said plurality of arms are located upstream of the propeller, said arms being shaped so as to impart a pre-rotation on the flow of water upstream of the propeller, said internal diameter of said nozzle gradually decreases from a maximum at the inlet opening to a minimum within the nozzle and then increases towards the outlet, said propulsion unit being coupled to the marine vessel in such a manner that the propulsion unit can be trimmed to a desired angle to cause the nozzle to generate a hydrodynamic lift component at the stern of the marine vessel.

2. The propulsion arrangement of claim 1, wherein the propulsion unit is coupled to the vessel via a constant velocity joint.

3. The propulsion arrangement of claim 2, wherein a set of radially extending support arms is located downstream of the propeller.

4. The propulsion arrangement of claim 3, wherein each arm of the set of arms located downstream of the propeller is shaped so as to act as a guide vane to control the flow of water through the nozzle past the propeller.

5. The propulsion arrangement of claim 4, wherein at least a trailing edge region of each vane is pivotable to thereby alter the flow characteristics of the water through the nozzle.

6. The propulsion arrangement of claim 4, wherein the chord length of each vane is less than the principal chord length around 0.7 radius of the blades making up the propeller.

7. The propulsion arrangement of claim 1, wherein the propeller is driven via its support shaft by a motor located remote from said propulsion unit.

8. The propulsion arrangement of claim 7, wherein the support shaft is driven by means of a drive shaft passing through a cowling to cooperate with a gear arrangement within the upstream hub.

9. The propulsion arrangement of claim 1, wherein the propeller is in the form of a rotor having a ring-shaped periphery, the outer surface of which is provided with engagement means for cooperation with a power transfer means.

10. The propulsion arrangement claim 9, wherein the rotor has a plurality of blades, and the ratio chord length to thickness of the blades at 0.7 radius lies between 9% and 15%.

11. The propulsion arrangement of claim 10, wherein the rotor has at least four blades.

12. The propulsion arrangement of claim 11, wherein the rotor is made from a plastics material.

13. The propulsion arrangement of claim 9, wherein said engagement means is a circumferentially extending toothed rack.

14. The propulsion arrangement of claim 13, wherein said power transfer means is a flexible belt provided with teeth for engagement with said toothed rack.

15. The propulsion arrangement of claim 9, wherein said power transfer means is driven by a motor positioned at a distance from said nozzle, and said power transfer means is encapsulated in a housing.

16. The propulsion arrangement of claim 15, wherein said housing for the power transfer means is streamline-shaped so as to reduce drag of the propulsion unit through the water.

17. The propulsion arrangement of claim 16, wherein when said power transfer means is a belt, the housing for the belt presents a through passage for the water.

18. The propulsion arrangement of claim 9, wherein the nozzle is provided with at least one trim flap.

19. The propulsion arrangement of claim 9, wherein a cooling passage is provided in the nozzle upstream of the propeller.

20. The propulsion arrangement of claim 9, wherein exhaust gas outlets are arranged downstream of the rotor, either in the housing or towards the outlet of the nozzle.

21. The propulsion arrangement of claim 1, further comprising at least two propellers, wherein two of said at least two propellers are counter-rotating.

22. The propulsion arrangement of claim 1, wherein the periphery of the propeller is in sealing relation to the inner surface of the nozzle to thereby substantially prevent flow of water between the periphery of the propeller and the nozzle.

* * * * *